US005384167A

United States Patent [19]

Nishiwaki et al.

[11] Patent Number: 5,384,167

[45] Date of Patent: Jan. 24, 1995

[54] METHOD FOR THE SURFACE TREATMENT OF A METAL BY ATMOSPHERIC PRESSURE PLASMA

[75] Inventors: Atsushi Nishiwaki, 1-11, Funakoshi-cho 2-chome, Chuo-ku, Osaka; Norihito Ikemiya, Takatsuki; Hiroshi Uchiyama; Hideo Inagaki, both of Hirakata; Yasuo Sawada, Tokyo; Kazumi Ogino, Osaka, all of Japan

[73] Assignees: E.C. Chemical Co., Ltd., Osaka; C. Itoh Fine Chemical Co., Ltd., Tokyo; Atsushi Nishiwaki, Osaka, all of Japan

[21] Appl. No.: 31,492

[22] Filed: Mar. 15, 1993

[30] Foreign Application Priority Data

Sep. 4, 1992 [JP] Japan ..... 4-260566

[51] Int. Cl.[6] ..... B05D 3/06

[52] U.S. Cl. ..... 427/569

[58] Field of Search ..... 427/576, 569

*Primary Examiner*—Bernard Pianalto

*Attorney, Agent, or Firm*—Wenderoth, Lind & Ponack

[57] ABSTRACT

This invention provides a method for the surface treatment of a metal, which comprises the steps of: placing at least a surface to be treated of a metal to be treated between two electrodes facing each other under an atmosphere of a mixed gas consisting of an inert gas and a reactant gas; and plasma exciting said mixed gas under atmospheric pressure to effect glow discharge between said electrodes. The method of the present invention uses an apparatus simpler than that used in a conventional method and can inject into the surface layer of a metal, even those elements which have been difficult to with the conventional method, and can readily modify surface properties of a metal such as surface hardness, surface wettability, etc.

7 Claims, 14 Drawing Sheets

CONTACT ANGLE OF COPPER WITH WATER ( after 5 minutes )

| | |
|---|---|
| A:Nontreated | H:Ar+He(2:1)+acetone |
| B:He 100% | I:He+thiol |
| C:Ar+He(1:1) | J:Ar+He(1:1)+thiol |
| D:Ar+He(2:1) | K:Ar+He(2:1)+thiol |
| E:Ar+acetone | L:He+$CF_4$ |
| F:He+acetone | M:Ar+He(1:1)+$CF_4$ |
| G:Ar+He(1:1)+acetone | N:Ar+He(2:1)+$CF_4$ |

CONTACT ANGLE OF ALUMINUM WITH WATER ( after 5 minutes )

| | |
|---|---|
| A:Nontreated | H:Ar+He(2:1)+acetone |
| B:He 100% | I:He+thiol |
| C:Ar+He(1:1) | J:Ar+He(1:1)+thiol |
| D:Ar+He(2:1) | K:Ar+He(2:1)+thiol |
| E:Ar+acetone | L:He+$CF_4$ |
| F:He+acetone | M:Ar+He(1:1)+$CF_4$ |
| G:Ar+He(1:1)+acetone | N:Ar+He(2:1)+$CF_4$ |

ESCA SPECTRA WHEN THREE KINDS OF ADDITIVES WERE ADDES TO He PLASMA

Ar + ACETONE

SOFT STEEL

Ar + ACETONE

SOFT STEEL

CONTACT ANGLE OF HIGH CARBON STEEL WITH WATER ( after 5 minutes )

| | |
|---|---|
| A:Nontreated | G:He+acetone+$CF_4$ |
| B:He+acetone | H:Ar+acetone+$CF_4$ |
| C:Ar+He(1:1)+acetone | I:He+thiol |
| D:Ar+acetone | J:Ar+He(1:1)+thiol |
| E:He+$CF_4$ | K:He+acetone+thiol |
| F:Ar+He(1:1)+$CF_4$ | L:Ar+acetone+thiol |

METHOD FOR THE SURFACE TREATMENT OF A METAL BY ATMOSPHERIC PRESSURE PLASMA

The present invention relates to a method for the surface treatment of a metal by atmospheric pressure plasma. The present invention provides a method for modifying the surface of a metal to be treated by performing a glow discharge which is stable under atmospheric pressure using an inert gas and a reactant gas.

Conventionally, a so-called ion injection method has been performed as a method for the surface treatment of a metal. Examples of the known ion injection method put in practice include a method in which an ion beam of several KeV to several MeV is irradiated onto a metal substrate in a high vacuum to add an element to a surface of the substrate to thereby modify the property of the surface, a method in which an ion beam is irradiated onto a single layer or a plurality of layers of an oxide layer or a nitride layer chemically formed on a substrate to mix the atom of the layer with the atom of the substrate to thereby modify the property of the surface, and so on.

These techniques have been developed as a method for doping impurities in particular in the field of semiconductor technologies, and are now utilized in fabrication steps of devices by p-n junction of silicon and for modifying the surface property of metals, ceramics and polymer materials.

Generally, as the ion injection method for metals, there has been performed ion injection of carbon, gaseous elements such as nitrogen and argon, and metal elements such as aluminum and chromium to iron, aluminum, titanium, etc. While the ion injection using an ion beam of these elements is performed at lower temperatures of several hundreds degree Celsius, it should be carried out in a high vacuum in order to increase ion speed and maintain high purity.

In the case of, for example, a gas or heated metal vapor which serves as an ion source, a high vacuum of $10^{-3}$ Torr is necessary and hence a vacuum pump, a high vacuum pump, an electron mirror accelerator, etc. are indispensable, resulting in a disadvantage that the total apparatus tends to be complicated and expensive.

Also, surface modification of metals has long since been performed. For example, there has been adopted a method in which a compound layer or a solid solution phase is formed on the surface of a metal by a phenomenon of thermal diffusion of elements such as carburizing, nitridation, carburizing nitridation, sulfurizing, oxidation, metal penetration, etc. Crank shafts, bites, drills, etc. are improved in respect to their surface hardness or abrasion resistance by subjecting steel to carburizing or nitridation treatment. However, these treatments require heating at high temperatures for a long time, which tends to cause deformation of the surface, change in size and coarsening of crystal grains. Therefore, a complicated heat treatment has been necessary in order to prevent this defect.

Recently, film formation methods such as CVD and PVD have been performed. These methods also have defects since CVD requires heating at generally about 1,000° C. and PVD requires heating at generally about 300° C.

The present invention provides a novel method for the surface treatment of a metal which is free of the above-mentioned defects of the prior art.

According to the present invention, there is provided a method for the surface treatment of a metal, which comprises placing at least a surface to be treated of a metal to be treated between two electrodes facing each other under an atmosphere of a mixed gas composed of an inert gas and a reactant gas and plasma exciting the mixed gas under atmospheric pressure to effect glow discharge between the electrodes.

According to the method for the surface treatment of the present invention, plasma excitation is carried out under atmospheric pressure to effect glow discharge, which is advantageous in that the apparatus required for the surface treatment is very simple as compared with the prior art, and in addition it is possible to inject those elements which have conventionally been difficult to inject into the surface layer of a metal and form an organic-binding coating on the surface of a metal so that considerable modification of surface properties, such as improvement of the surface hardness, modification of surface wettability, and improvement of surface resistance, can be realized.

Examples of inert gas which can be used in the method for the surface treatment of a metal include helium, argon, neon, and mixtures thereof. Among them, helium, argon, and mixed gas composed of argon and helium are used preferably.

As the reactant gas which can be used in the method for the surface treatment of the present invention includes gases of carbon-containing compounds, gases of sulfur-containing compounds, gases of oxygen-containing compounds, gases of halogen-containing compounds, gases of nitrogen-containing compounds, etc. Among them, gases of carbon-containing compounds, gases of sulfur-containing compounds and gases of halogen-containing compounds are used preferably.

As the carbon-containing compounds, there can be cited, for example, ketones, among which ketones whose alkyl groups have each 4 or less carbon atoms such as acetone, methyl ethyl ketone, methyl isobutyl ketone, etc. are preferred. Acetone is particularly preferred.

As the sulfur-containing compounds, there can be cited, for example, triazinethiols, mercaptans, carbon disulfide, thiourea, etc., among which triazinethiols are preferred. Of the-triazinethiols, 2-dibutylamino-4,6-dimercapto-s-triazine is particularly preferred.

As the halogen-containing compounds, there can be cited, for example, halogenated hydrocarbons, of which halogenated hydrocarbons, in particular halogenated hydrocarbons having 4 or less carbon atoms are preferred. Carbon tetrafluoride is particularly preferred.

The amount of the reactant gas is 5 to 10 ppm or more, preferably 10 to 1,000 ppm, and more preferably 10 to 100 ppm, in the inert gas.

On the other hand, examples of the metal constituting an object to be treated by the method for the surface treatment of the present invention includes, besides copper, steel, and aluminum, silver and group IV metals such as silicon and germanium. Among them, copper, aluminum, silver, soft steel and high carbon steel are preferred.

In the method for the surface treatment of the present invention, glow discharge is carried out by applying a high voltage of a high frequency. The voltage to be applied is generally 1,000 to 8,000 V, and preferably 1,000 to 5,000 V.

The frequency of the power source may be any within the range of 500 to 100,000 Hz. Preferably, a frequency of 1,000 to 10,000 Hz is used. If it exceeds 100,000 Hz, it cannot be used since it not only overlaps broadcasting frequencies but also it involves generation of heat. If it is below 500 Hz, no stable glow discharge can be obtained.

Hereinafter, some embodiments of the present invention will be described in detail with reference to the accompanying drawings.

BRIEF DESCRIPTION OF THE DRAWINGS

As shown in FIG. 1, the apparatus includes two electrodes 1 facing each other, and a mixed gas composed of argon and acetone is introduced in the apparatus through an inlet 3 to replace air in the apparatus thereby. Mixing proportion of argon to acetone by volume is 99.5 parts of argon to 0.5 part of acetone (which corresponds to 13 ppm of acetone in argon). A polyimide film (100 μm thick) 4 as a dielectric for preventing the occurrence of spark discharge is attached on the lower electrode, and a pure copper plate 2, which is an object to be treated, is placed between the electrodes as shown in FIG. 1. The dielectric has an area greater than that of the electrode in order to prevent sparks from going around to the facing electrode. The dielectric may be attached to each of the lower and upper electrodes or only to the upper electrode.

After air is replaced by a mixed gas composed argon and acetone completely, a voltage of 3,000 V of a frequency of 3 KHz is applied between the upper and lower electrodes. A bluish white glow discharge is generated to cause plasma excitation. After keeping this state as it is for 2 minutes, the surface treatment of the pure copper plate is over.

No change is visually observed on the surface of the pure copper plate just after it is taken out from the apparatus. Then, the surface was analyzed by X ray photoelectron spectroscopy (hereinafter, also referred to as ESCA), and the results are shown in FIGS. 2 and 3.

Figure 2:
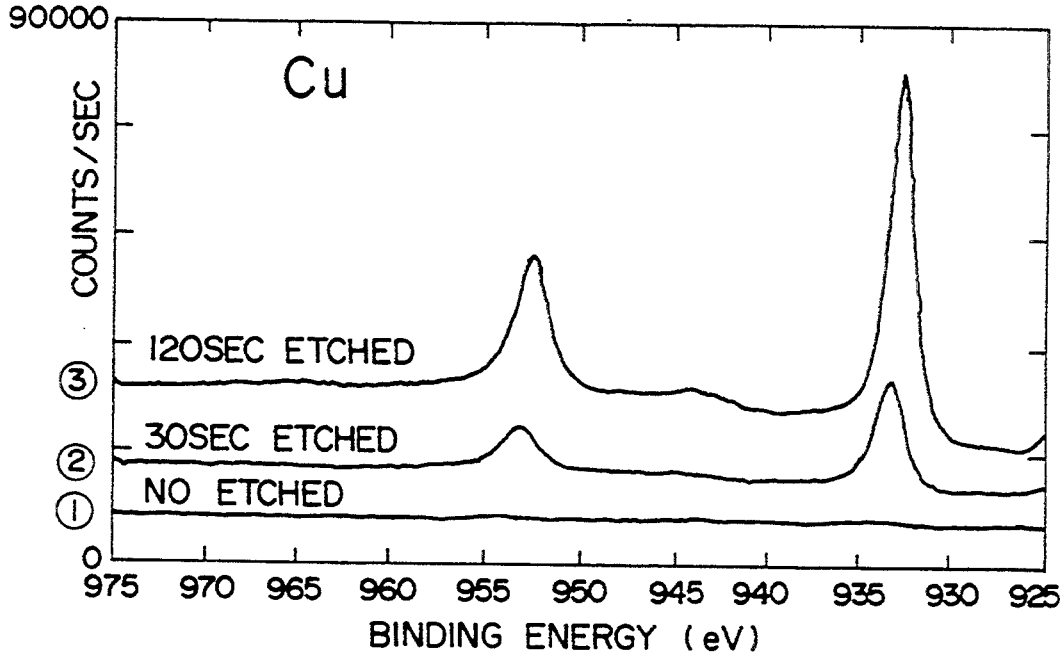

FIG. 2 shows no peak that indicates the presence of copper. This is because the surface is covered with a coating containing no copper (presumably organic bond coating). On Surface (2) obtained by etching the plasma-treated surface with argon at 100 μA and 500 V for 30 seconds there appears a low copper peak. A clear peak of copper appears on Surface (3) subjected to etching for a further 120 seconds, which indicates the surface of copper is exposed by 120 seconds' etching. To note, etching with argon ions is a method used in ESCA in order to examine distribution of elements and change in their binding states in the direction of depth, and etching at 100 μA and 500 V for 30 seconds resulted in etching to a depth of 25 Angstroms and for 120 seconds to a depth of 100 Angstroms.

Figure 3:
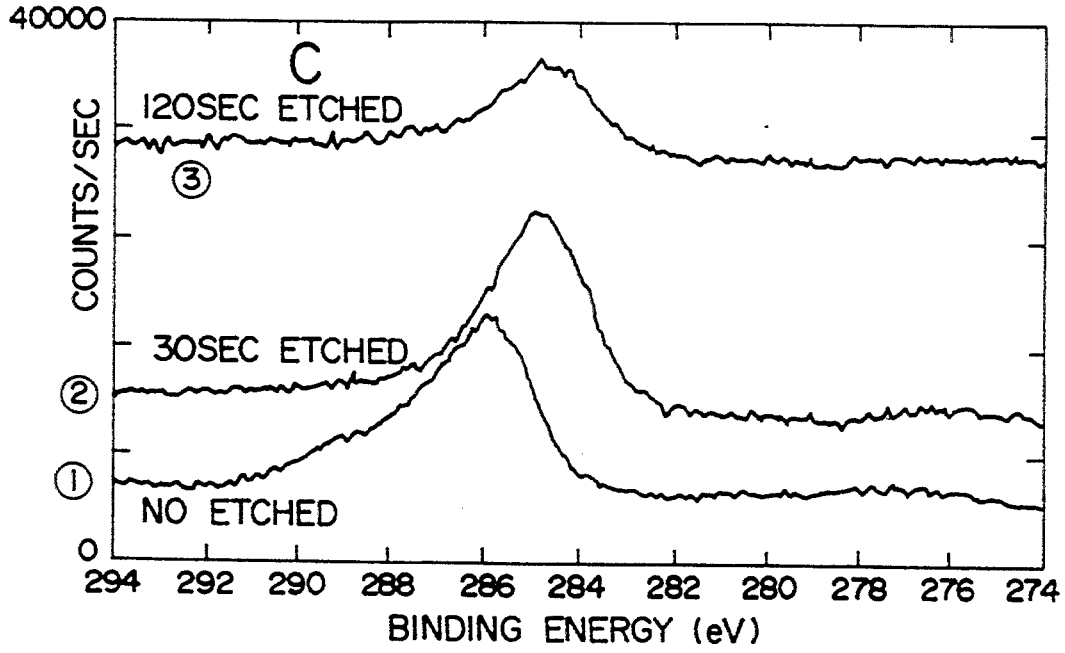

FIG. 3 illustrates the results of the examination of presence of carbon (C). A clear peak of carbon appears on Surface (1) obtained by plasma treatment alone. The height of the peak of carbon does not change substantially on Surface (2) obtained by etching for 30 seconds under the same conditions as described above. On Surface (3) obtained by etching for 120 seconds, carbon remains. The binding energy is 287.6 eV after the plasma treatment alone, which value indicates the presence of carbon of organic bond. On the surface after 30 seconds' etching, the binding energy is shifted to 285 eV, which indicates presence of carbon atoms of pure graphite bond. Thus, these show that carbon atoms in the acetone molecule are injected to a depth of 100 Angstroms or more below the surface of copper. Injection of carbon atoms into copper to a depth of 100 Angstroms or more in spite of the fact that copper does not react with carbon nor form a compound is not described in the prior art and is astonishing.

Figure 4:
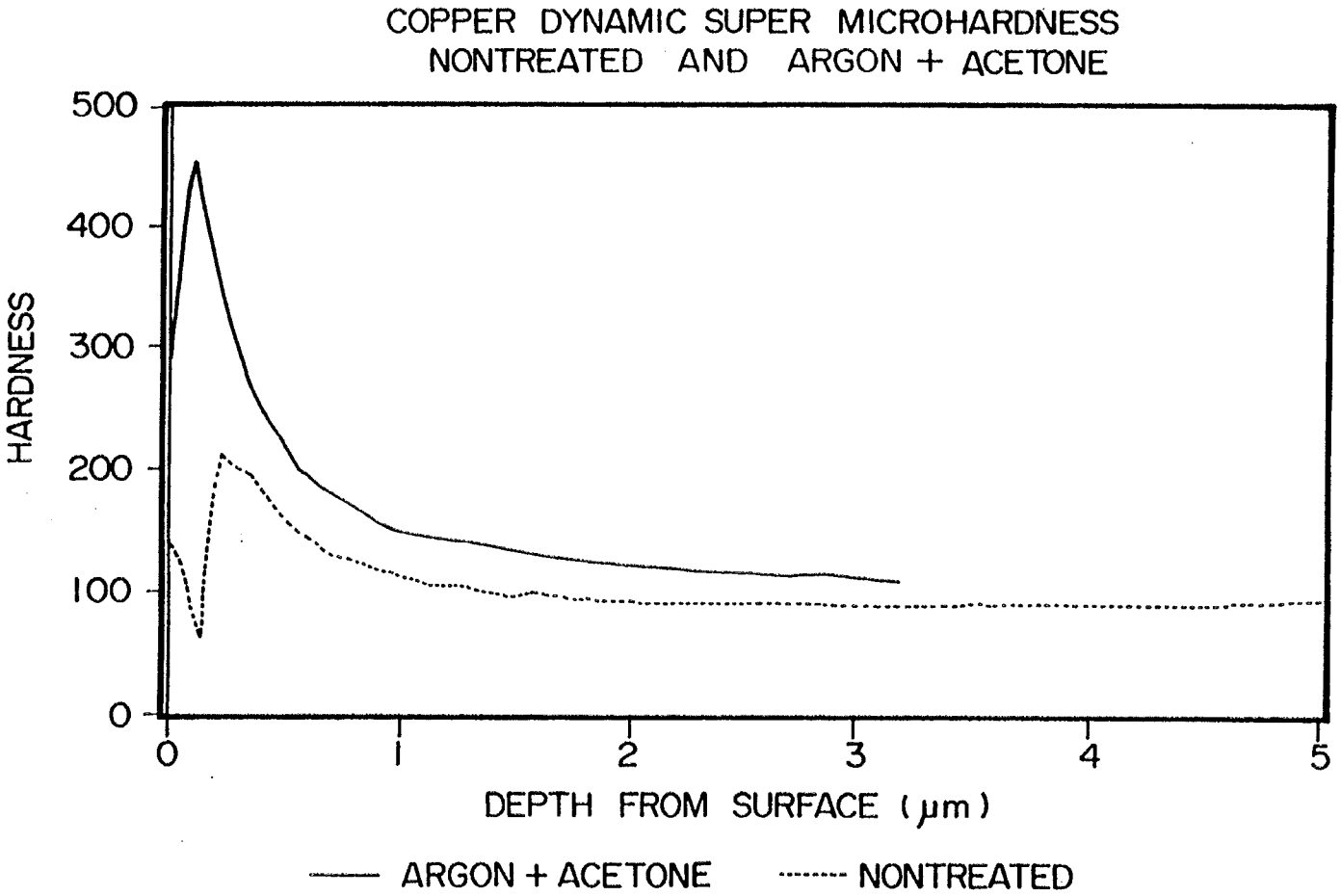

The surface hardness of the pure copper plate which received the above-described surface treatment is shown in FIG. 4. Pure copper subjected to the surface treatment of the present invention has remarkably improved abrasion resistance due to an increase in the surface hardness and markedly improved resistance to oxidation due to the presence of carbon coating of organic bond.

Surface treatment of pure copper is carried out under the same conditions as in the above-described embodiment except that argon, helium or a mixed gas composed of argon and helium (argon:helium = 1:1, or 2:1) is used as an inert gas, acetone, 2-dibutylamino-4,6-dimercapto-s-triazine or carbon tetrafluoride ($CF_4$) is used as a reactant gas, with acetone and 2-dibutylamino-4,6-dimercapto-s-triazine being used each in an amount of 10 ppm, and carbon tetrafluoride being used in a concentration of 3 parts by weight in 96 parts by weight of inert gas. The wettability of the surface of pure copper subjected to the surface treatment against deionized water is measured in terms of contact angle. Results are shown in FIG. 5.

Figure 5:
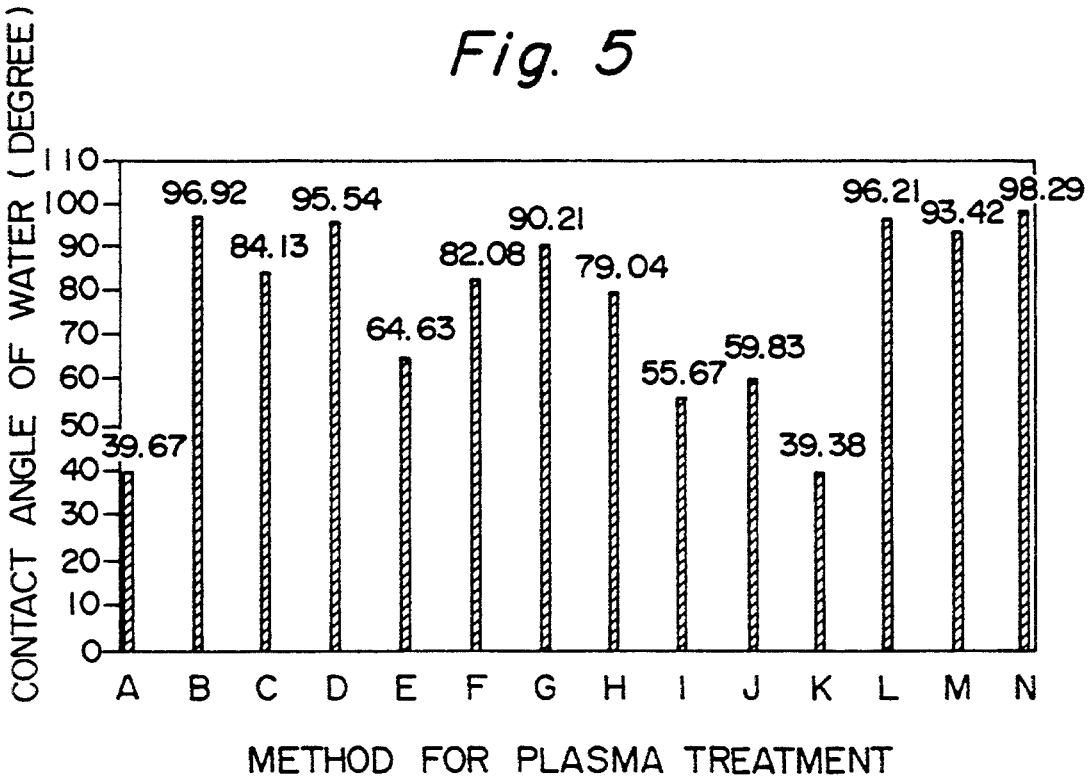

As will be apparent from FIG. 5, in the case of samples L, M and N which use carbon tetrafluoride, the contact angle increases considerably as compared with nontreated sample A, and the wettability decreases to a great extent.

To note, the reactant gas need not be introduced through the inlet in the form of gas. For example, a compound which is solid at room temperature may be placed on the lower electrode which is heated to a small thickness and perform glow discharge to vaporize it and convert it into plasma in situ in the glow discharge state.

Figure 6:
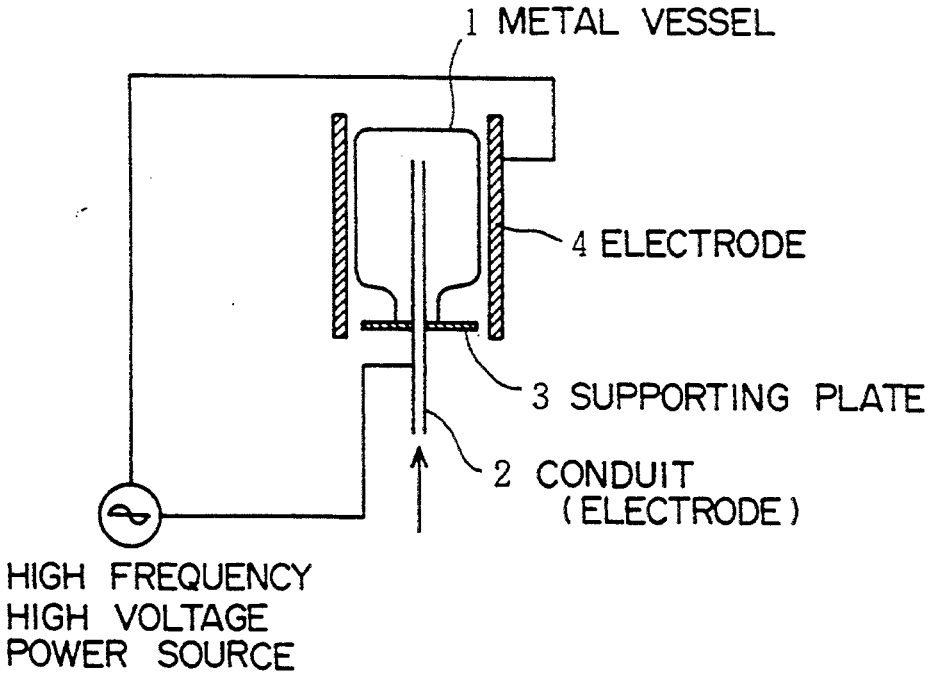

FIG. 6 is a schematic cross sectional view showing an atmospheric pressure glow discharge plasma generating apparatus used in another embodiment of the present invention. In this embodiment, only an inner surface of a metal vessel 1 is surface-treated. A mixed gas composed of an inert gas and a reactant gas is introduced into the inside of the vessel through a conduit 2 which serves also as an electrode, and glow discharge is allowed to proceed between an electrode 4 and the electrode 2 to carry out surface treatment of the inner surface of the vessel. A dielectric is used but is not shown.

EXAMPLES

Hereinafter, the present invention will be described in greater detail by way of examples.

Example 1

An aluminum plate of 1 mm thick was used in the same manner as the above-described embodiments. Proportion of argon gas and acetone was 99.7 parts of argon gas to 0.3 part of acetone. When expressed in weight, acetone was 8 ppm.

Figure 7A:
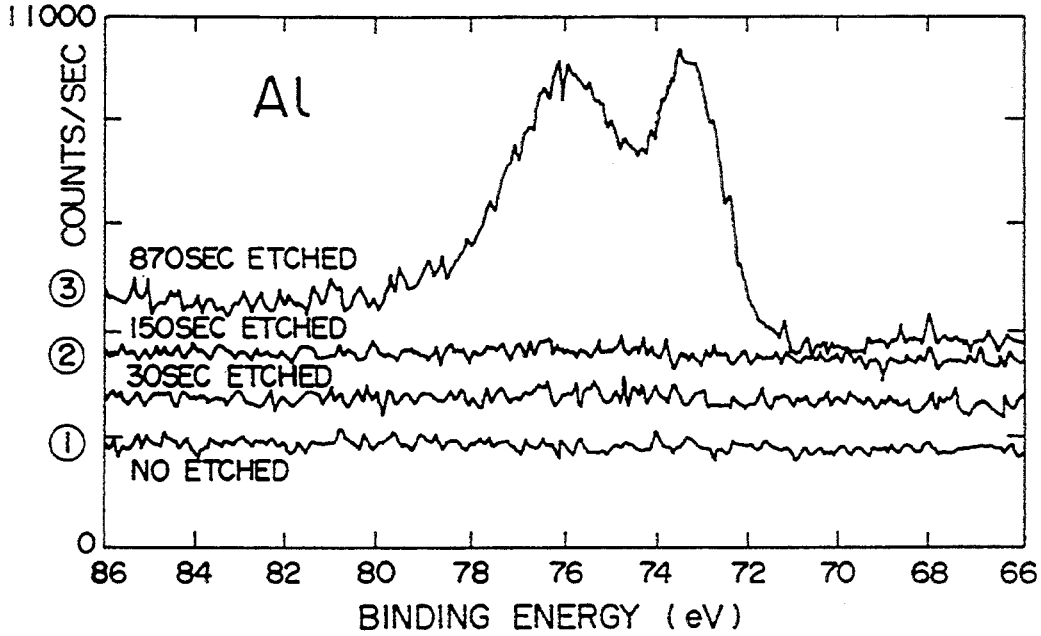
Figure 7B:
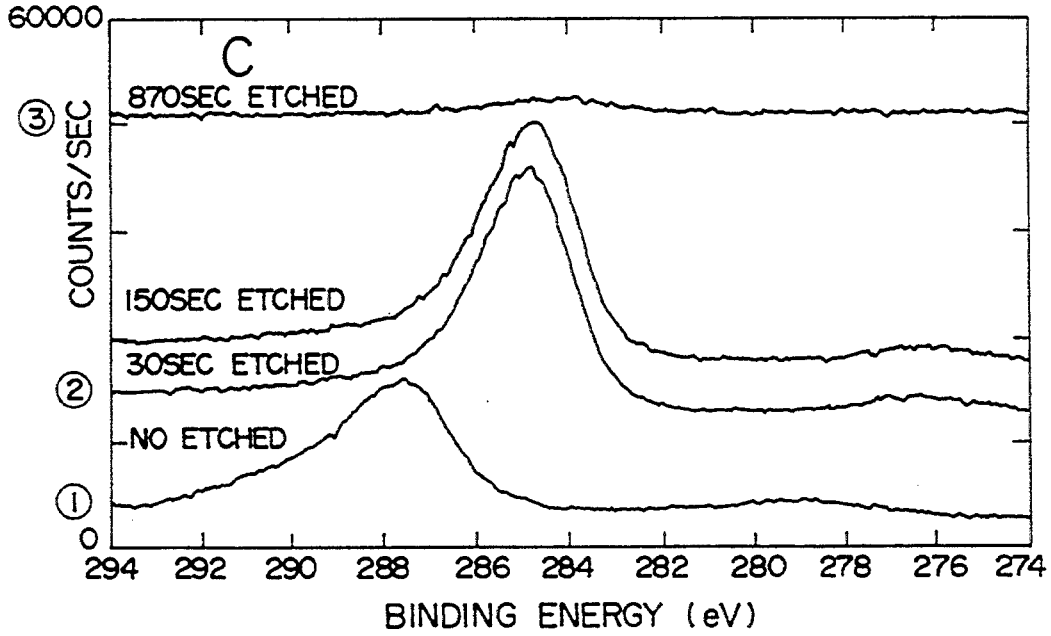

Glow discharge was generated by applying a voltage of 3,000 V of a frequency of 1,000 Hz, and plasma treatment was allowed to proceed as it was for 2 minutes. No abnormality was noticed by visual observation. The surface was analyzed by ESCA and results obtained are shown in FIGS. 7-A and 7-B.

In the state (1) of aluminum (Al) subjected to plasma treatment alone, no Al was found at all on its surface. Even with 150 seconds' argon etching, Al was not found yet (2). Al appeared after 870 seconds' etching. Since 30 seconds' etching corresponded to the etched depth of 25 Angstroms, total etched depth of 725 Angstroms was attained.

Figure 8:
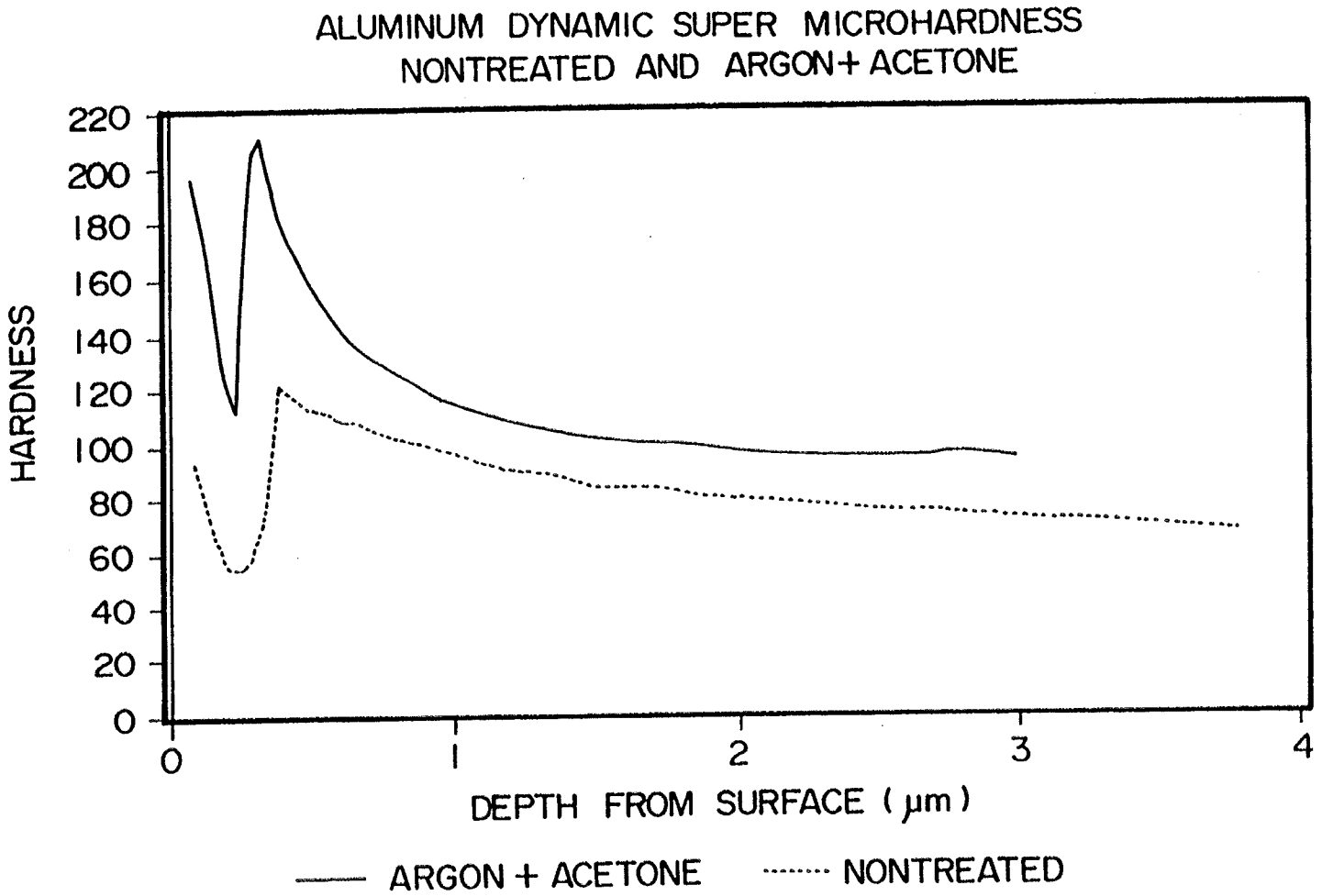

Carbon (C) had a binding energy of 287.6 eV in the state where only plasma treatment was performed (1), which indicates presence of organic bonding carbon. That is, while the surface is covered with an organic bond film, its binding energy shifted to 285 eV with argon etching for 30 seconds or longer (2). This is quite the same as in the case of copper described above, i.e., indicates presence of carbon atoms of pure graphite bond, and only a trace of carbon atom remained after 870 seconds' etching. Thus, injection of carbon atoms to a depth of 725 Angstroms was confirmed. Further, aluminum showed increase in hardness as shown in FIG. 8, and its effect was able to be confirmed.

Figure 9A:
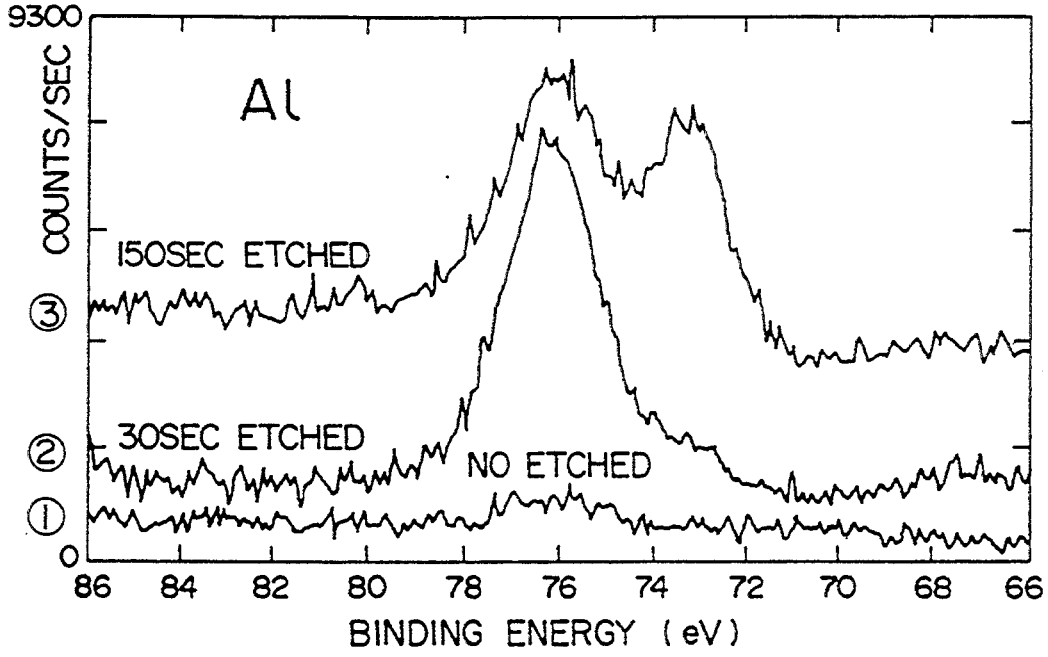
Figure 9B:
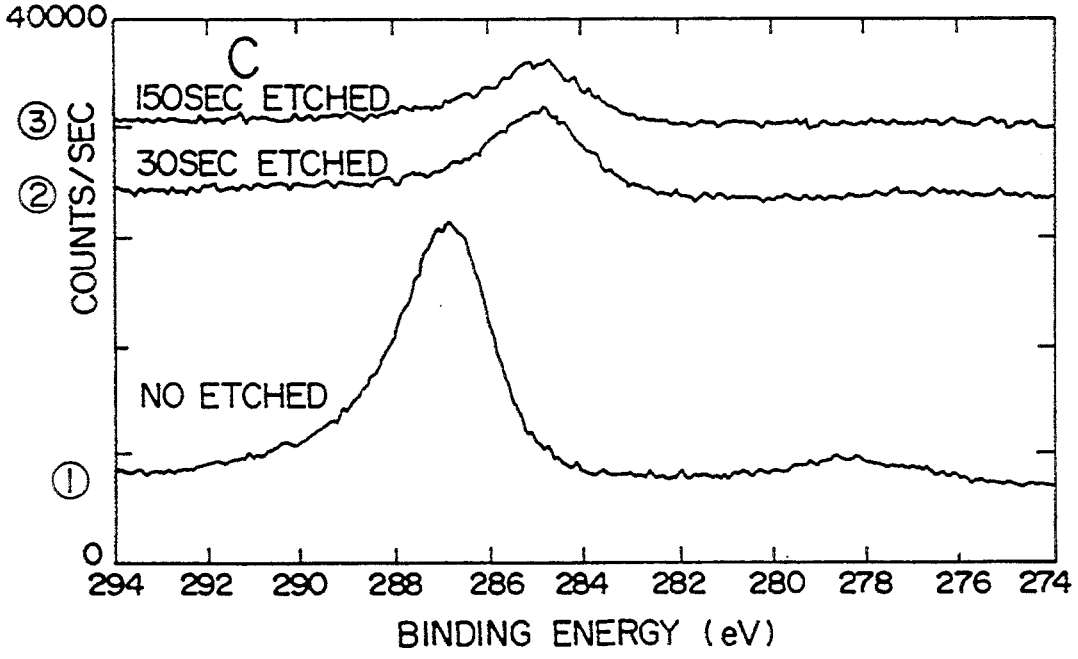

Next, plasma treatment of aluminum was performed under the same conditions as in Example 1 in which a mixed gas composed of helium gas and acetone was used. Results of analyses of the surface are shown in FIGS. 9-A and 9-B, respectively.

That is, in the case of aluminum (Al), a trace of Al was found in the state of Al subjected to plasma treatment alone (1). On the other hand, when the state (1) of carbon (C) was observed, the presence of organic bonding carbon having a binding energy of 287.6 eV was more abundant than argon in Example 1. When argon etching was performed for 30 seconds and 150 seconds, respectively, as in (2) and (3), the presence of carbon atoms of graphite bond whose binding energy shifted to 285 eV was much less than argon. Therefore, it can be seen that in the case of aluminum, helium gas has a relatively high ion injection effect, which is the object of the present invention.

Figure 10:
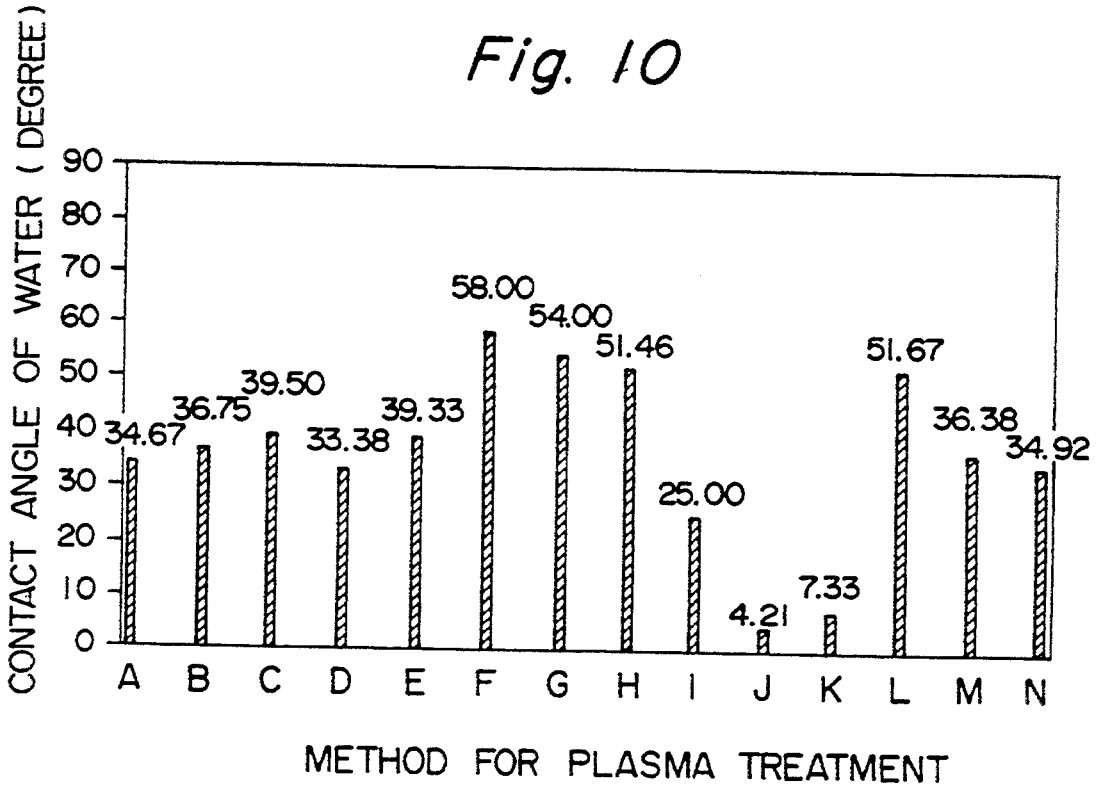

Wettability with deionized water in terms of contact angle was measured under the same conditions as in the above-described embodiments, resulting in that generally contact angle decreased (wetting property was improved) unlike copper. Results obtained are shown in FIG. 10.

Example 2

Next, Steel was treated under the same conditions as in Example 1 in order to examine changes in the properties of the surface. A soft steel of 1 mm thick as a steel was placed between electrodes and argon, helium, or a mixed gas composed of the same amounts of argon and helium was used as an inert gas, to which was added acetone, 2-dibutylamino-4,6-dimercapto-s-triazine (one of triazinethiols) or carbon tetrafluoride, followed by glow discharge plasma treatment. The treating conditions were 3,000 Hz, a voltage of 3,000 V, power of 50 W, and 2 minutes.

Figure 11A:
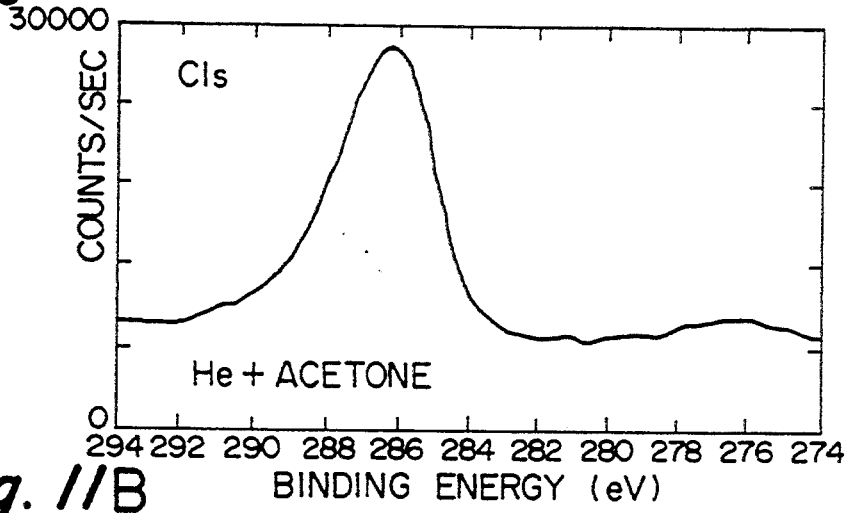
Figure 11B:
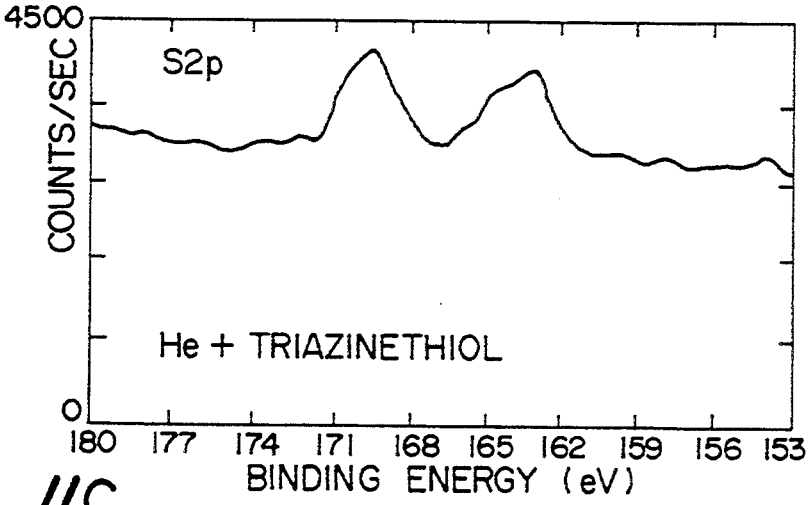
Figure 11C:
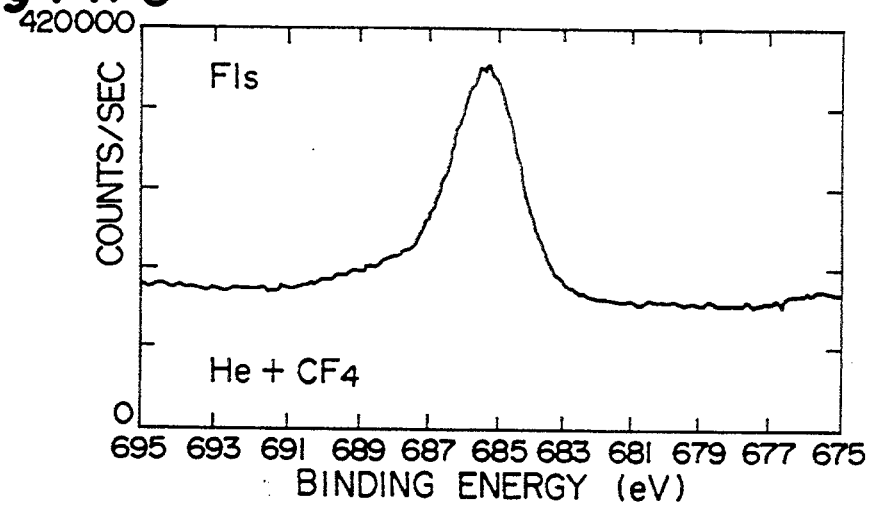

First, each of the three reactant gases described above was added to helium, and glow discharge plasma treatment was conducted therein. The surface layer was analyzed by ESCA. Results obtained are shown in FIGS. 11-A, 11-B and 11-C.

To note, 1 g of 2-dibutylamino-4,6-dimercapto-s-triazine, which is powder having a melting point of 137° C., was placed flat on the heated dielectric on the low electrode to melt it and conduct plasma treatment and vaporize it.

In the case of acetone, 2-dibutylamino-4,6-dimercapto-s-triazine and carbon tetrafluoride allowed sulfur atoms and fluorine atoms, respectively, to enter the surface layer, resulting in that changes in its structure were observed.

Figure 12:
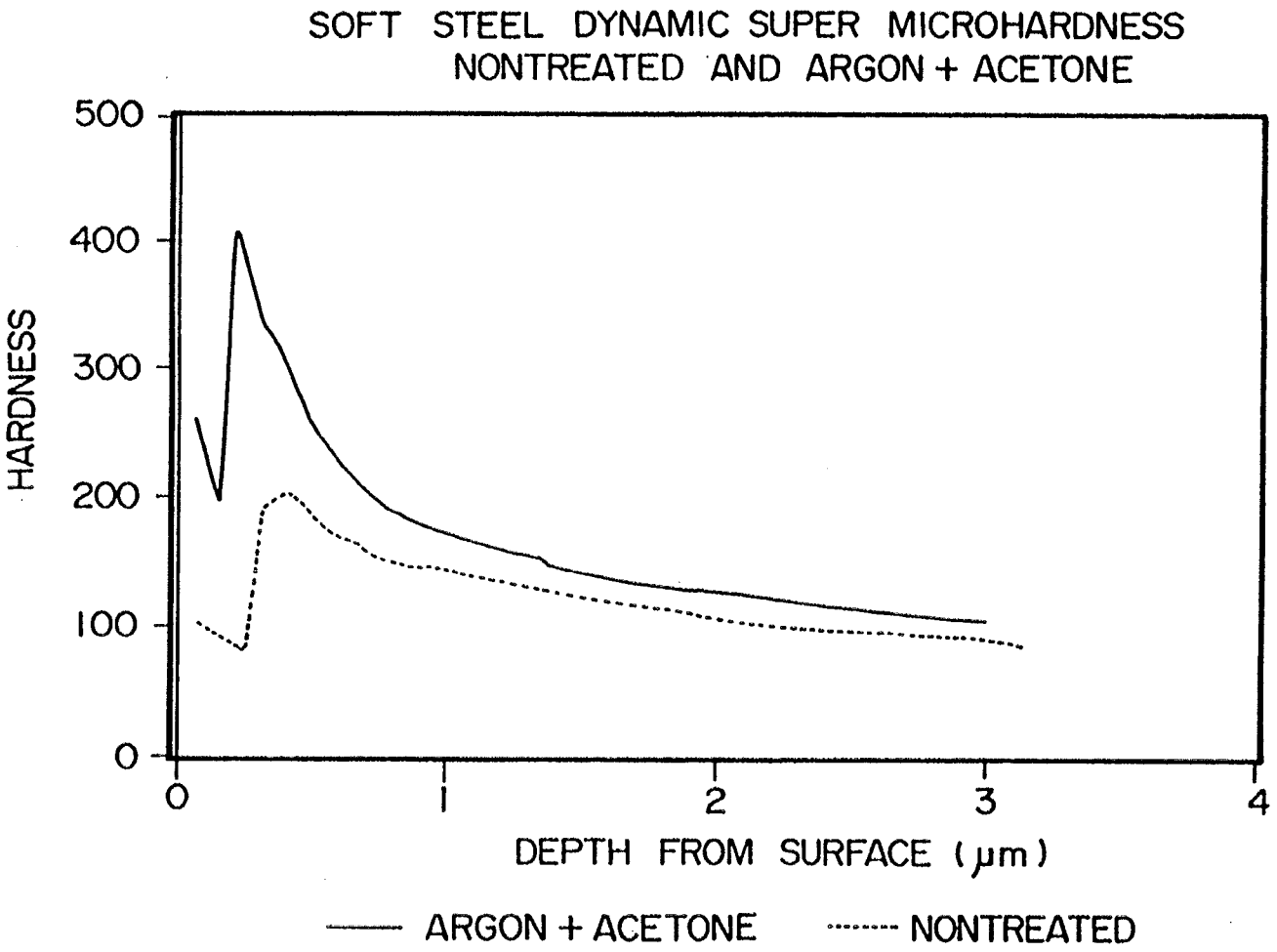
Figure 13A:
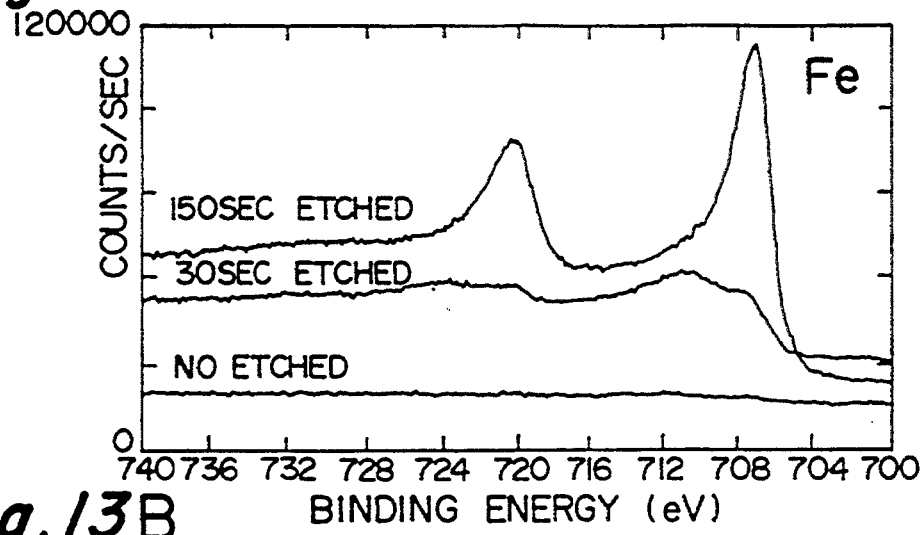
Figure 13B:
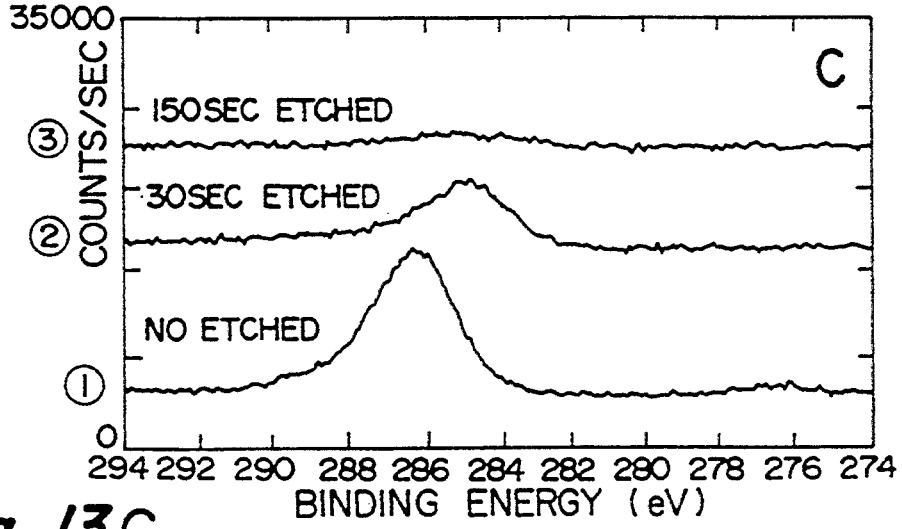
Figure 13C:
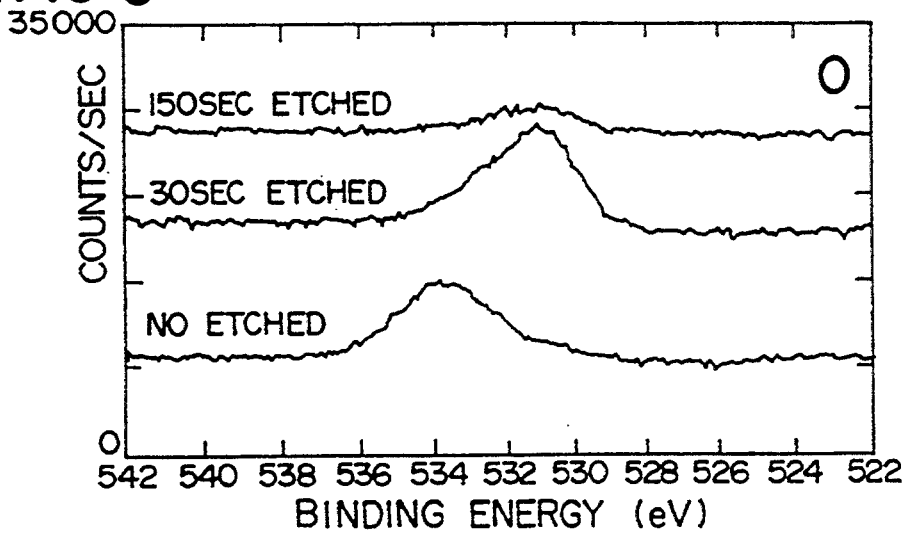
Figure 14A:
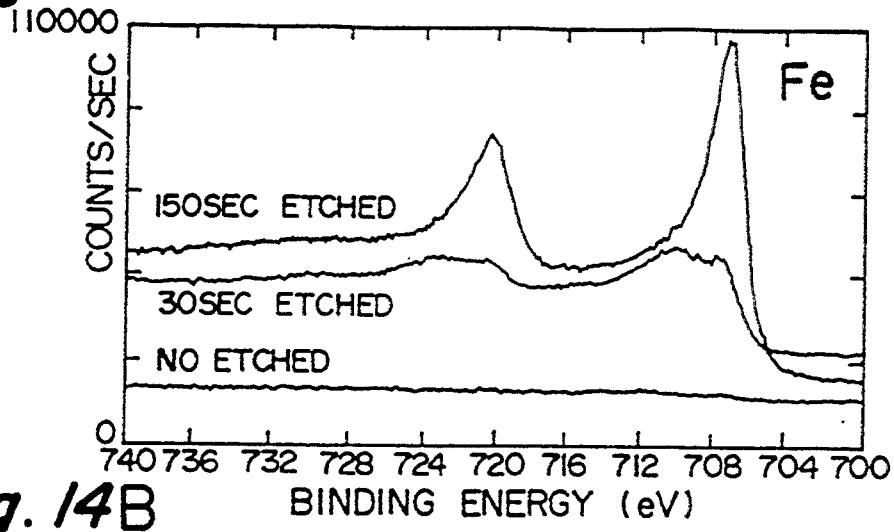
Figure 14B:
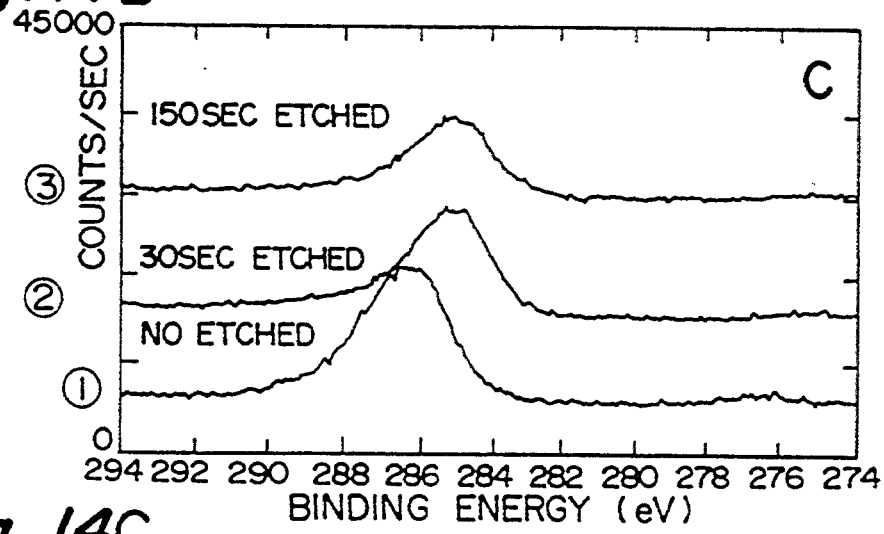
Figure 14C:
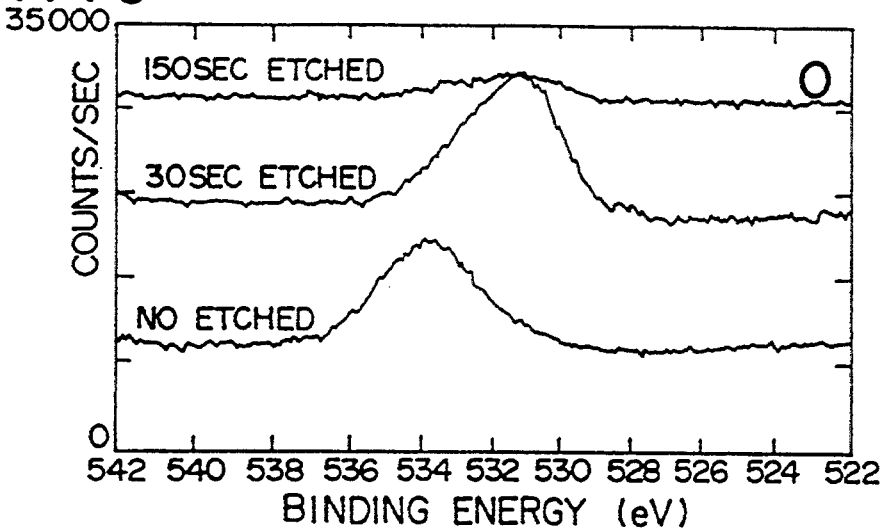

When acetone was added, microhardness was measured as in the case of aluminum or copper. Results obtained are shown in FIG. 12. Increase in hardness as compared with nontreated product was observed, which indicates that carbon was injected into the inside. This is clear from analyses by ESCA results of which are shown in FIGS. 13A, 13B and 13C and FIGS. 14A, 14B and 14C.

That is, so far as carbon atoms in soft steel are concerned, when acetone was added to argon, substantially no carbon atom was found after 150 seconds' etching whereas carbon atoms were able to be found even after 150 seconds' etching when acetone was added to helium. Since the 30 seconds' etching corresponded to an etched depth of 25 Angstroms, 150 seconds' etching gave an etched depth of 125 Angstroms, and the binding energy was shifted to 285 eV. These clearly indicate that carbon of graphite bond was injected to a depth of 100 Angstroms or more. Further, as for the inert gas, helium had greater effect than argon on soft steel.

Example 3

Glow discharge plasma treatment was conducted in the same manner as in Example 2 using a commercially available high carbon steel of 1 mm thick. The same inert gas and additives as those used in Example 2 were employed.

Figure 15:
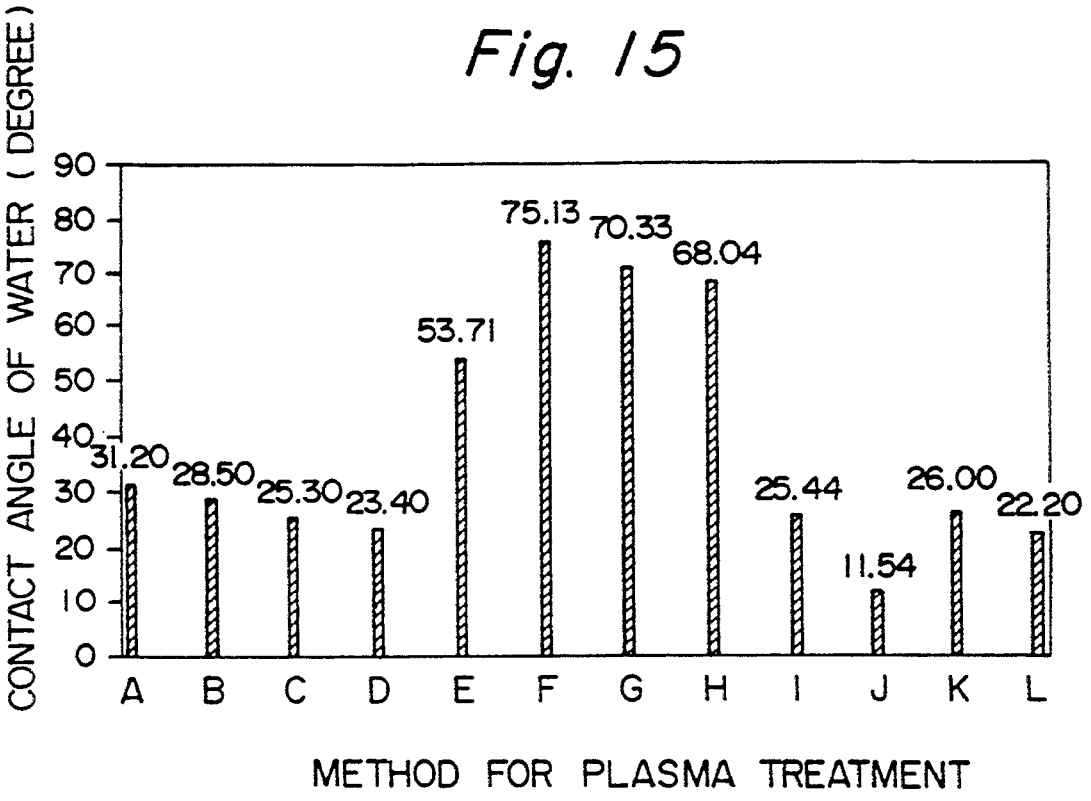

Wettability of the treated surface with deionized was measured in terms of contact angle. Results obtained are shown in FIG. 15. Tendencies were observed that as compared with nontreated product, those to which acetone and triazinethiol (2-dibutylamino-4,6-dimercapto-s-triazine) were added showed decrease in contact angle (improvement in wetting property) whereas those to which carbon tetrafluoride was added exhibited increase in contact angle (decrease in wetting property).

Example 4

A silver plate of 1 mm thick was used in the same manner as in Example 1. Proportion of argon gas to acetone by volume was 99.8 parts of argon gas to 0.2 part of acetone. When expressed in weight, acetone was about 5 ppm.

To 6 liters of the mixed gas was added 200 cc of $CF_4$ (carbon tetrafluoride), and the resulting mixture was introduced into a reaction vessel, and glow discharge plasma treatment was performed by applying a voltage of 3,000 V of a frequency of 3,000 Hz at a power of 50 W for 2 minutes. The surface seemed slightly blackened by visual observation. The surface was analyzed by ESCA. Results obtained are shown in FIG. 16.

Figure 1:
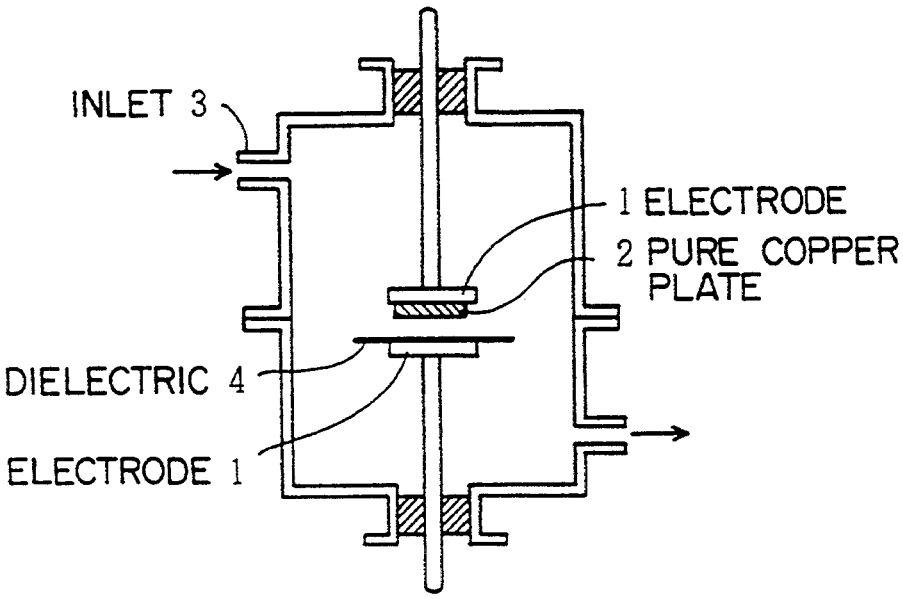
FIG. 1 is a schematic cross sectional view showing an atmospheric pressure glow discharge plasma generating apparatus used in the present invention.
Figure 16A:
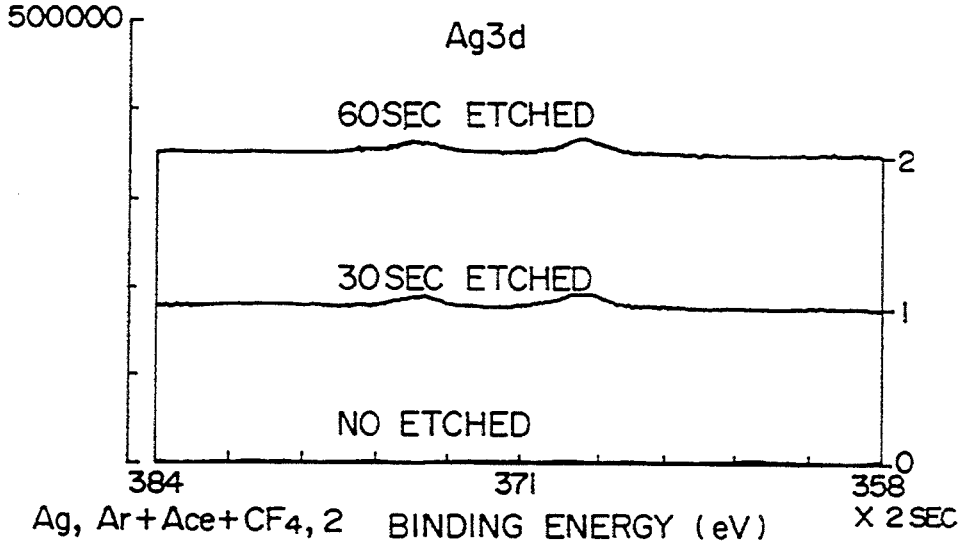
Figure 16B:
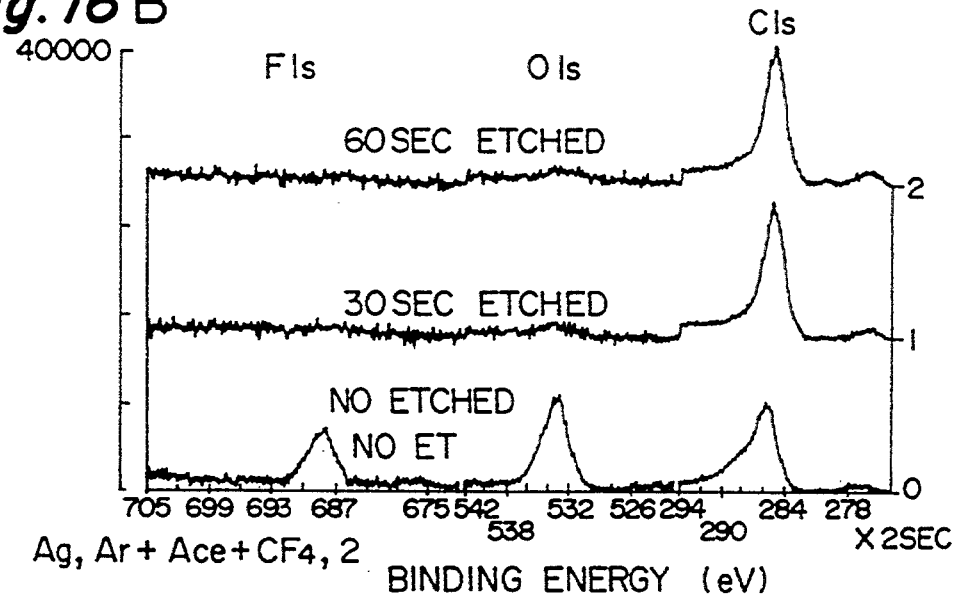

In FIGS. 16A and 16B, 1 is a surface of a silver plate. Almost no silver was exposed but instead almost all the surface was covered with carbon, etc. 2 represents measurement of fluorine, oxygen and carbon. When etched with argon for 30 seconds, no fluorine nor oxygen was found at all whereas carbon showed a strong presence after 60 seconds' etching, indicating that carbon entered into the inside. In the case of silver, 30 seconds' etching gas an etched depth of 60 Angstroms.

What is claimed is:

1. A method for the surface treatment of a metal, which comprises the steps of:

placing at least a surface to be treated of a metal to be treated between two electrodes facing each other under an atmosphere of a mixed gas consisting of an inert gas and a reactant gas; and plasma exciting said mixed gas under atmospheric pressure to effect glow discharge between said electrodes.

2. The method as claimed in claim 1, wherein said reactant gas is a gas of a carbon-containing compound, a gas of a sulfur-containing compound, a gas of a halogen-containing compound, or a gas of a nitrogen-containing compound.

3. The method as claimed in claim 2, wherein said reactant gas is a gas of a carbon-containing compound, a gas of a sulfur-containing compound, or a gas of a halogen-containing compound.

4. The method as claimed in claim 3, wherein said reactant gas is a ketone, a halogenated hydrocarbon or a triazinethiol.

5. The method as claimed in claim 4, wherein said reactant gas is a acetone, carbon tetrafluoride, or 2-dibutylamino-4,6-dimercapto-s-triazine.

6. The method as claimed in any one of claims 1 to 5, wherein said inert gas is argon or/and helium.

7. The method as claimed in any one of claims 1 to 5, wherein said metal is high carbon steel, soft steel, aluminum or copper.

* * * * *